US009169589B1

(12) United States Patent
Sales

(10) Patent No.: US 9,169,589 B1
(45) Date of Patent: Oct. 27, 2015

(54) SPACE SAVING WASHING AND DRYING SYSTEM

(71) Applicant: ShaQuavis D. Sales, McCormick, SC (US)

(72) Inventor: ShaQuavis D. Sales, McCormick, SC (US)

( * ) Notice: Subject to any disclaimer, the term of this patent is extended or adjusted under 35 U.S.C. 154(b) by 139 days.

(21) Appl. No.: 14/051,124

(22) Filed: Oct. 10, 2013

(51) Int. Cl.
*D06F 25/00* (2006.01)

(52) U.S. Cl.
CPC ..... *D06F 25/00* (2013.01)

(58) Field of Classification Search
CPC ..... D06F 25/00; D06F 21/00; D06F 1/12; D06F 39/00; D06F 37/26; D06F 37/264
USPC ..... 68/142; D32/29; 210/381, 407
See application file for complete search history.

(56) References Cited

U.S. PATENT DOCUMENTS

| | | | | |
|---|---|---|---|---|
| 2,062,030 | A * | 11/1936 | Johnson | 68/143 |
| D174,702 | S * | 5/1955 | Oberg | D32/29 |
| 2,777,313 | A | 1/1957 | Dodge | |
| D301,781 | S | 6/1989 | Bover | |
| 5,029,458 | A | 7/1991 | Obata et al. | |
| D426,686 | S * | 6/2000 | Clausen et al. | D32/29 |
| 6,434,857 | B1 | 8/2002 | Anderson et al. | |
| 6,530,245 | B1 | 3/2003 | Kawabata et al. | |
| 6,748,772 | B2 | 6/2004 | Lee et al. | |
| 7,627,960 | B2 * | 12/2009 | Beyerle et al. | 34/602 |
| 8,181,355 | B2 * | 5/2012 | Geyer et al. | 34/58 |
| D683,092 | S * | 5/2013 | Taewan et al. | D32/29 |
| D722,212 | S * | 2/2015 | Kim et al. | D32/29 |
| 2001/0015082 | A1 | 8/2001 | Minayoshi et al. | |
| 2007/0084254 | A1 * | 4/2007 | Messina | 68/142 |
| 2010/0307203 | A1 * | 12/2010 | Gomez Caudevilla et al. | 68/142 |
| 2013/0047679 | A1 * | 2/2013 | Cinello et al. | 68/212 |
| 2013/0081432 | A1 * | 4/2013 | Choi et al. | 68/142 |

* cited by examiner

*Primary Examiner* — Michael Barr
*Assistant Examiner* — Rita Adhlakha

(57) ABSTRACT

A space saving clothes washing and drying system features an appliance housing having a cavity located therein. The appliance housing features a clothes aperture having a door pivotally located thereon. The system features a perforated cylindrical drum located within an outer drum located in the cavity. An open semi-cylindrical scoop is located on a drum exterior surface on each perforation for aiding airflow. The system features a drying power system. The outer drum is fluidly connected to an intake vent close to an appliance housing bottom end via ducting. The outer drum is fluidly connected to an exhaust vent close to an appliance housing top end via ducting. The system features a washing power system. The outer drum is fluidly connected to hot and cold water supply piping. The outer drum is fluidly connected to a water drain.

7 Claims, 6 Drawing Sheets

(Top View)

(ISO View)

(Back View)

(Top View)

(Detail View)

(Front View)

(Side View)

SPACE SAVING WASHING AND DRYING SYSTEM

FIELD OF THE INVENTION

The present invention relates to clothes washing machines and dryers, or more specifically, clothes washing machine and dryer combinations.

BACKGROUND OF THE INVENTION

The need to wash and dry clothing has existed as long as clothing has been used by mankind. Early washing machines were messy and required a great deal of effort to operate, while drying was accomplished by hanging the clothing in the air. Washing machines and dryers have evolved significantly over the past couple of hundred years to the point of being efficient modern appliances, however, in nearly all cases, both a washer and a dryer are needed thereby taking up significant space in a house The present invention features a space saving clothes washing and drying system.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims

SUMMARY OF THE INVENTION

The present invention features a space saving clothes washing and drying system. In some embodiments, the system comprises an appliance housing having a cavity located therein. In some embodiments, the appliance housing comprises a clothes aperture located on an appliance housing front surface, in some embodiments, the appliance housing comprises a plurality of laundry additive apertures located on an appliance housing top surface.

In some embodiments, the system comprises a door pivotally located on the clothes aperture. In some embodiments, the door seals the clothes aperture. In some embodiments, the system comprises a perforated cylindrical drum located in an outer drum. In some embodiments, the perforated drum and the outer drum are each located in the cavity. In some embodiments, the perforated drum rotates in the outer drum on a horizontal axis A. In some embodiments, an open semi-cylindrical scoop is located on a drum exterior surface on each perforation for aiding airflow.

In some embodiments, the system comprises a drying power system. In some embodiments, the outer drum is fluidly connected to an intake vent close to an appliance housing bottom end via ducting. In some embodiments, the outer drum is fluidly connected to an exhaust vent close to an appliance housing top end via ducting. In some embodiments, the system comprises a washing power system. In some embodiments, the outer drum is fluidly connected to hot and cold water supply piping. In some embodiments, the outer drum is fluidly connected to a water drain.

In some embodiments, the system comprises three modes of operation including a washing only mode, a drying only mode, and a sequential washing then drying mode:

DESCRIPTION OF PREFERRED EMBODIMENTS

Figure 1:
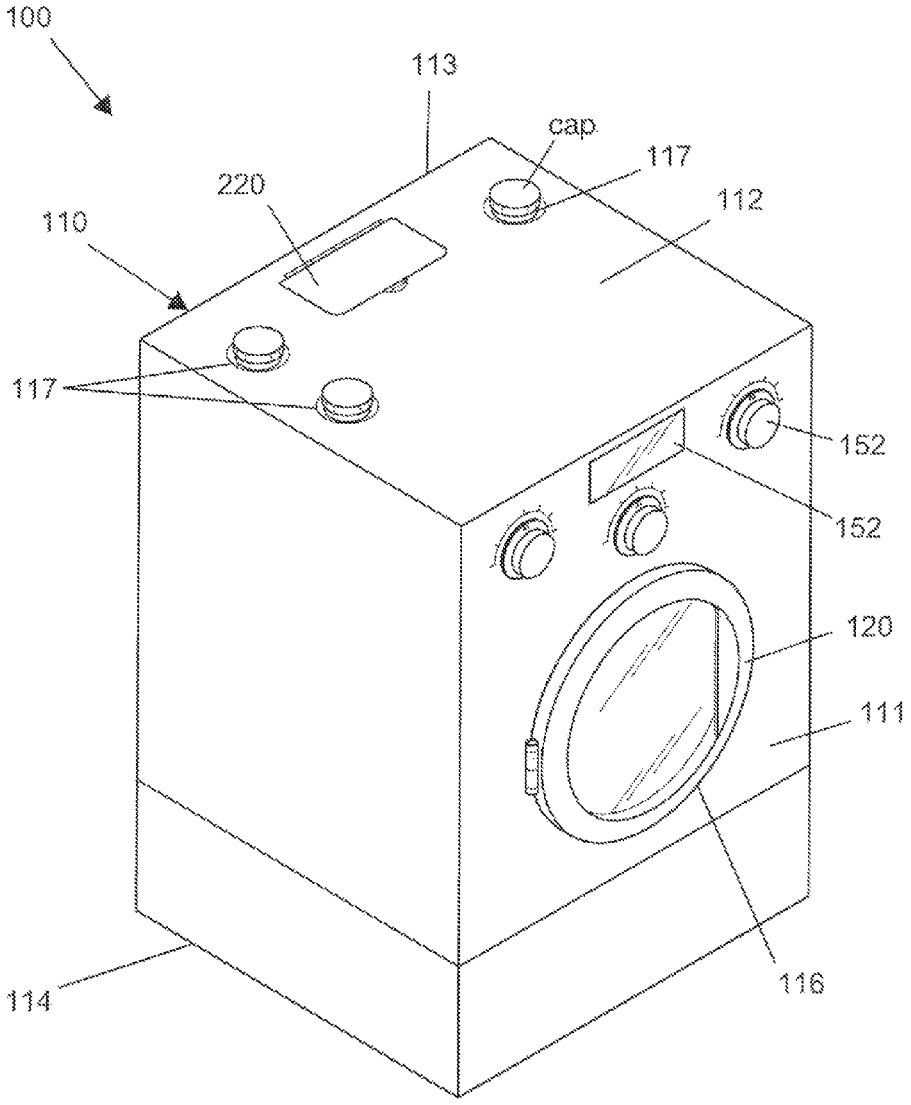
FIG. 1 shows a perspective view of the present invention.
Figure 2:
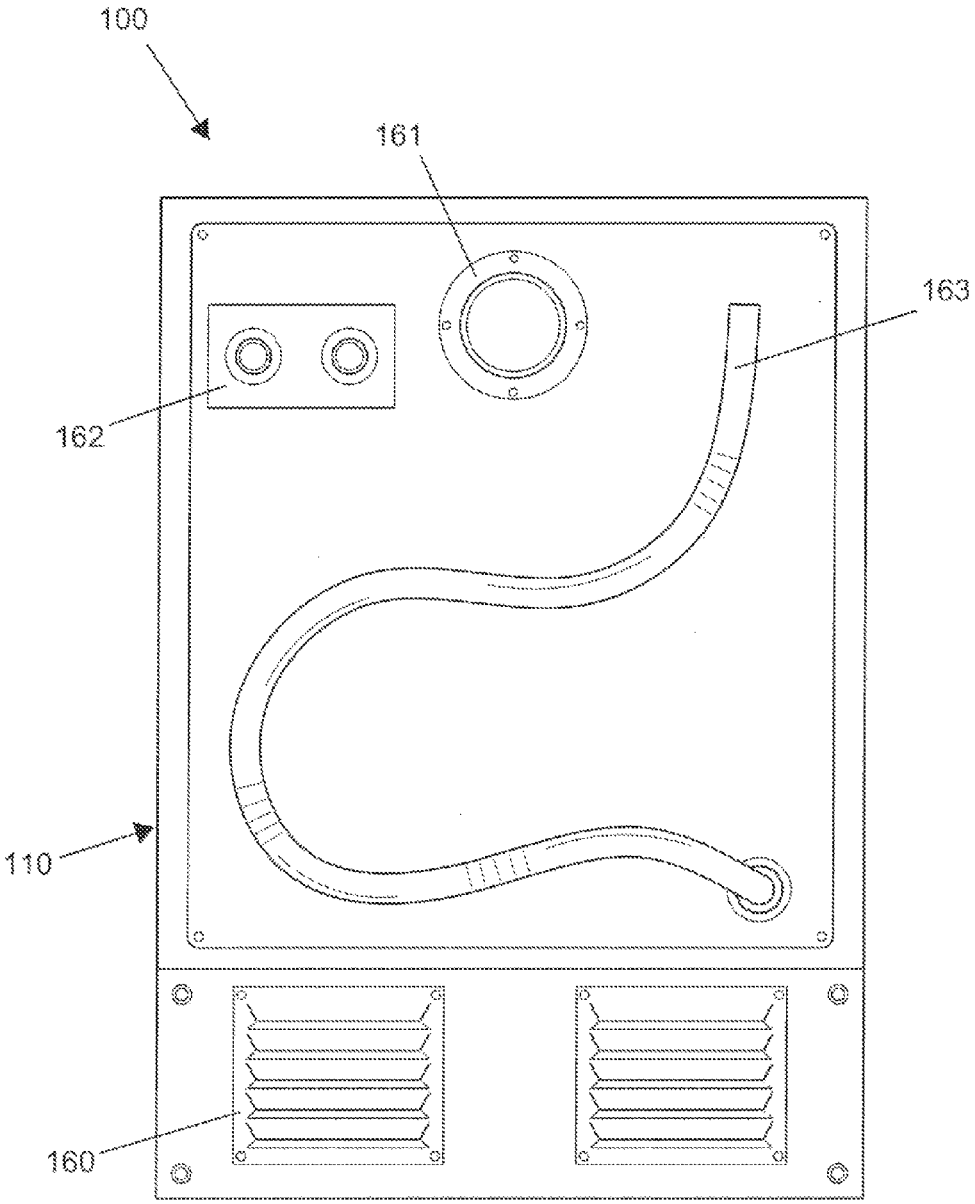
FIG. 2 shows a rear view of the present invention.
Figure 3:
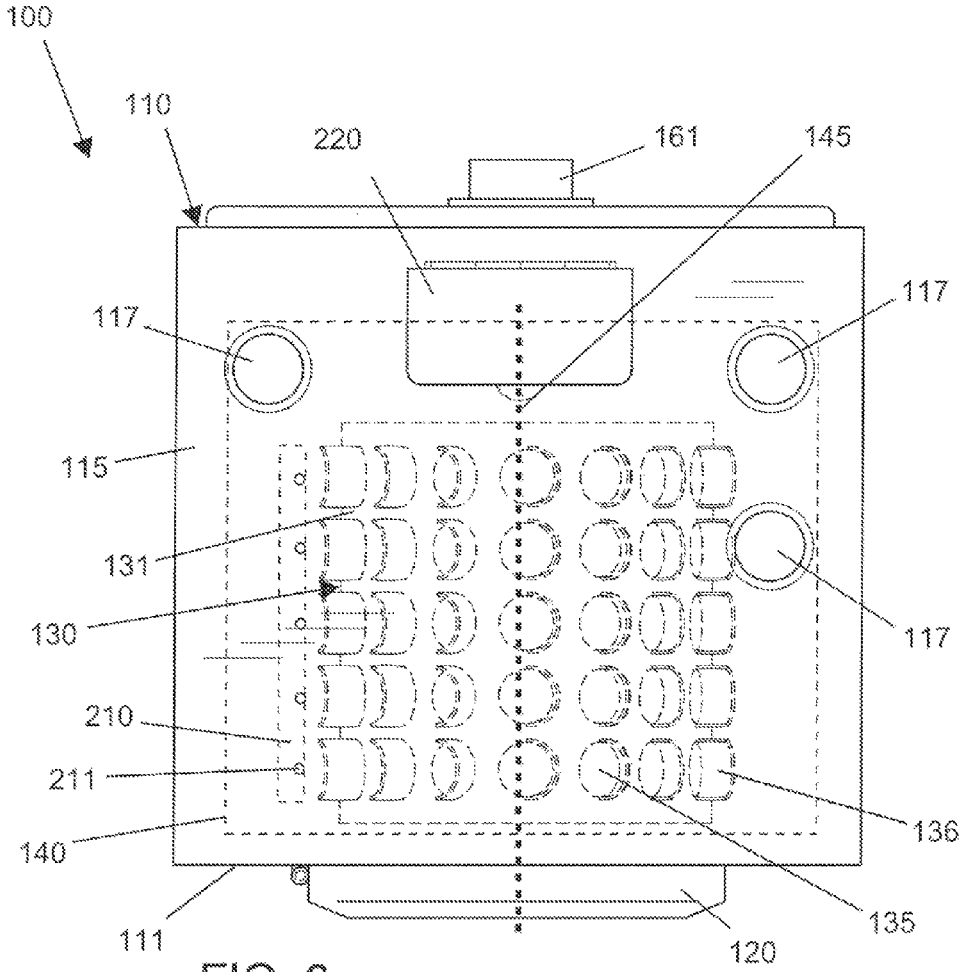
FIG. 3 shows a top view of the present invention.
Figure 4:
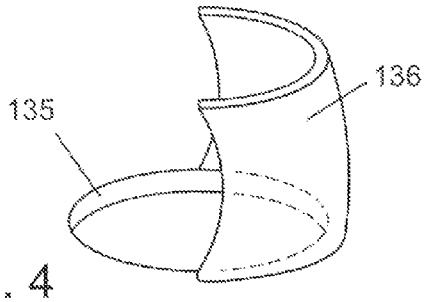
FIG. 4 shows a detail view of the perforation and the scoop of the present invention.
Figure 5:
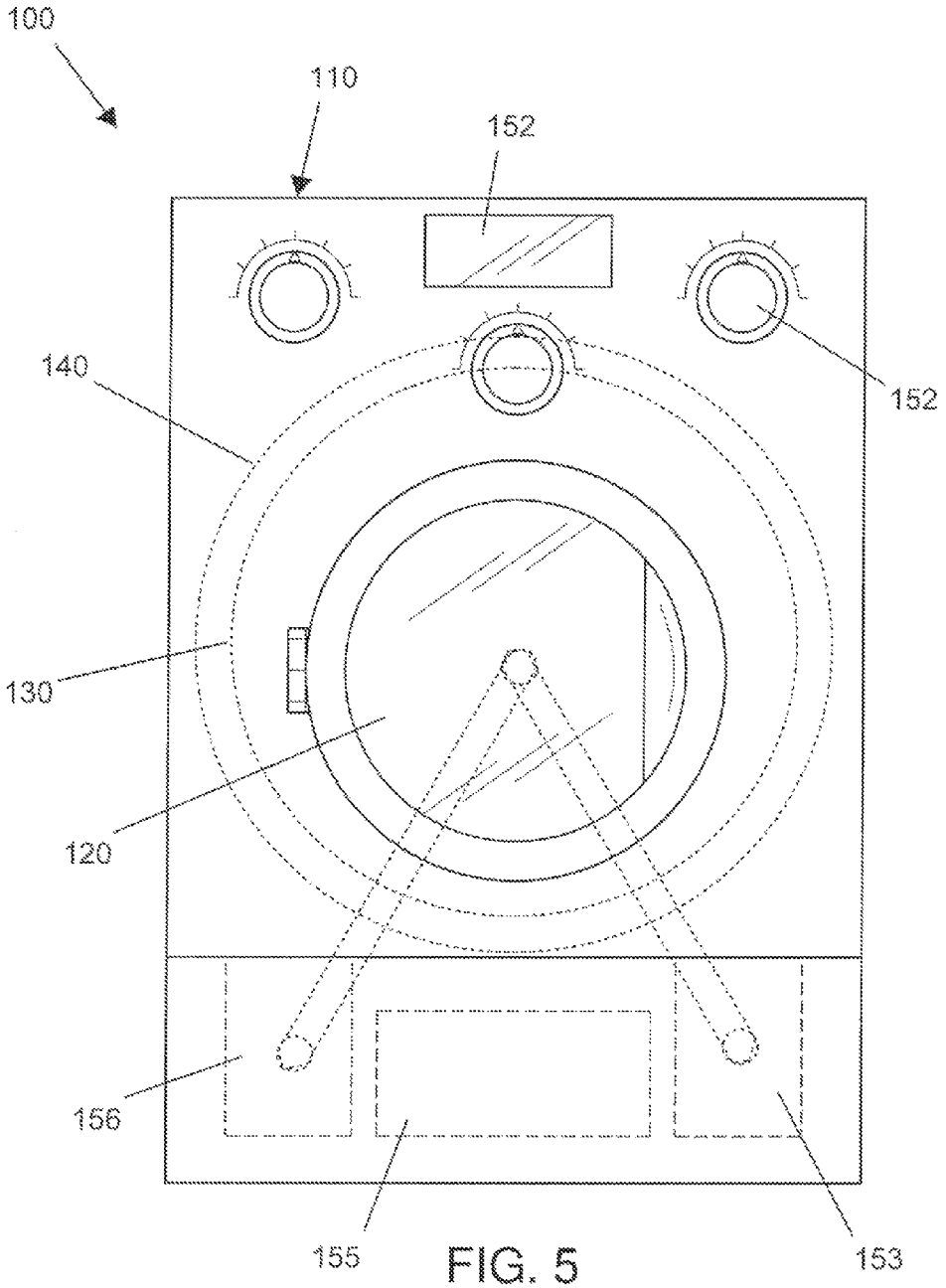
FIG. 5 shows a front view of the present invention.
Figure 6:
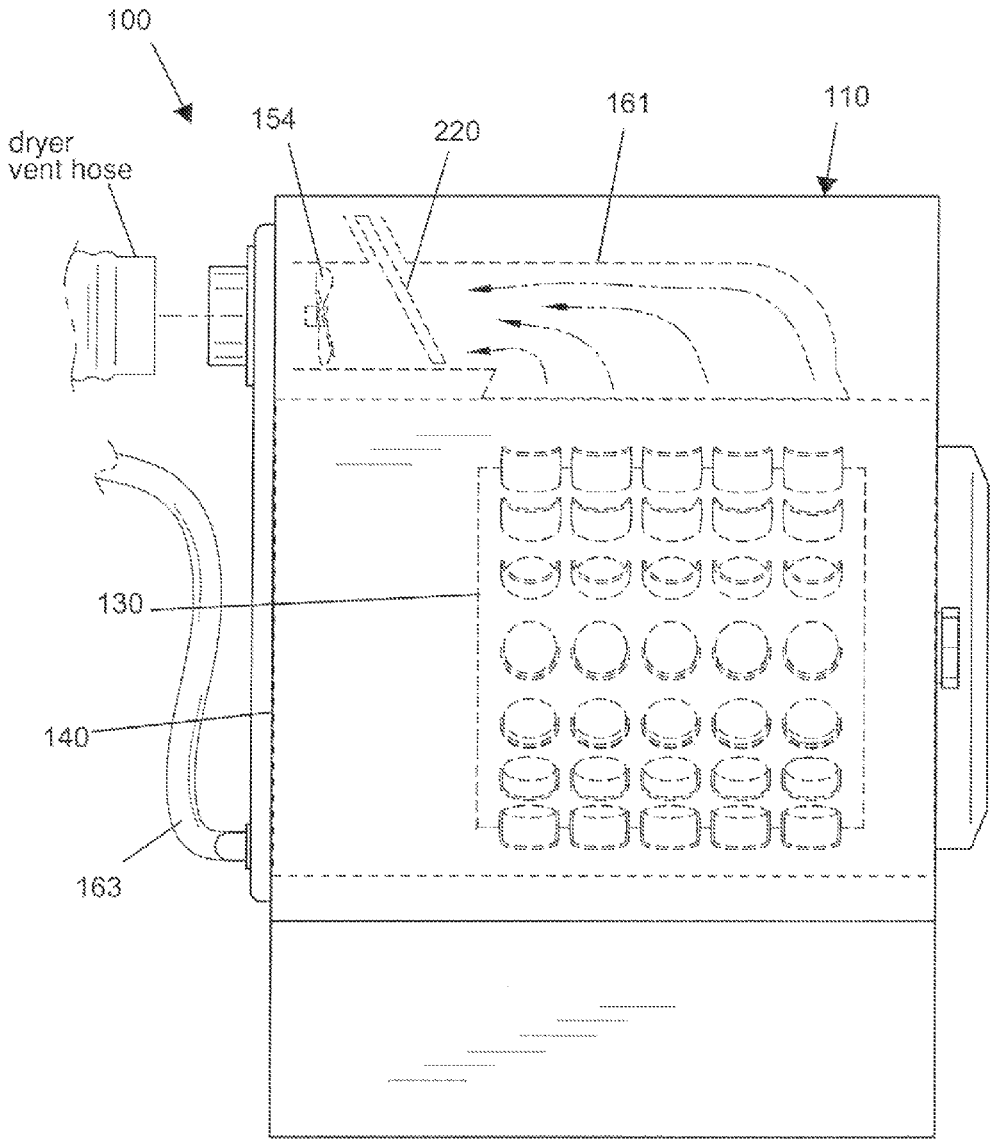
FIG. 6 shows a slide view of the present invention.
Figure 7:
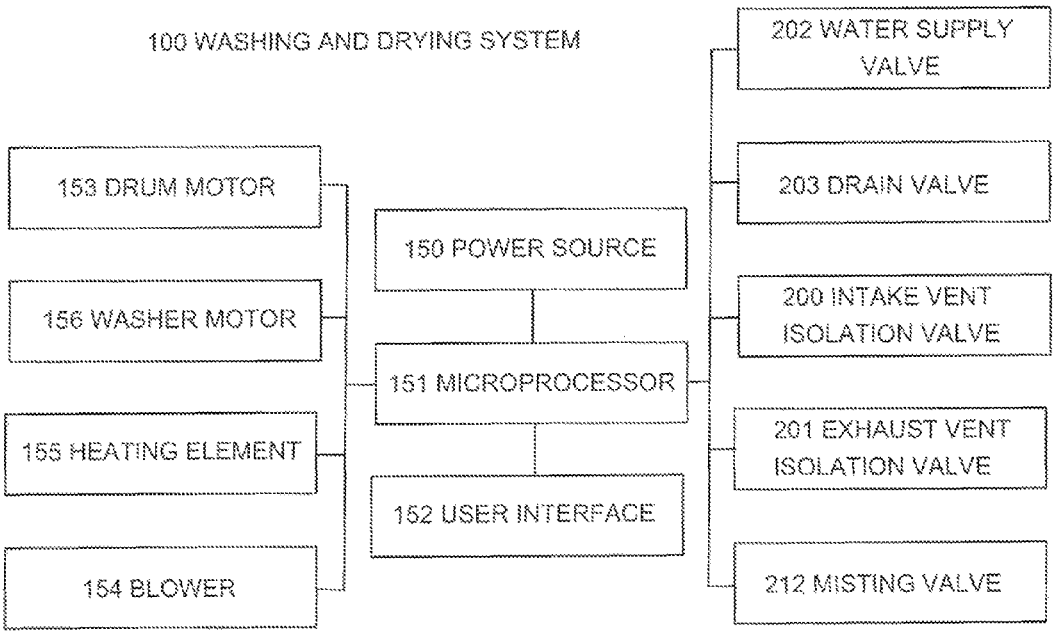
FIG. 7 shows a schematic view of the present invention.

Following is a list of elements corresponding to a particular element referred to herein:

100 Washing and drying system
110 Appliance housing
111 Housing front surface
112 Housing top surface
113 Housing top end
114 Housing bottom end
115 Cavity
116 Clothes aperture
117 Laundry additive aperture
120 Door
130 Perforated drum
131 Drum exterior surface
135 Perforation
136 Scoop
140 Outer drum
145 Axis A
150 Power source
151 Microprocessor
152 User interface
153 Drum motor
154 Blower
155 Heating element
156 Washer motor
160 Intake vent
161 Exhaust vent
162 Water supply piping
163 Water drain
200 Intake vent isolation valve
201 Exhaust vent isolation valve
202 Water supply valve
203 Drain valve
210 Misting unit
211 Misting orifices
212 Misting valve
220 Lint screen Referring now to FIG. 1-7, the present invention features a space saving clothes washing and drying system (100). In some embodiments, the system (100) comprises an appliance housing (110) having a cavity (115) located therein. In some embodiments, the appliance housing (110) comprises a clothes aperture (116) located on an appliance housing front surface (111) thereon. In some embodiments, the appliance housing (110) comprises a plurality of laundry additive apertures (117) located on an appliance housing top surface (112) thereon, In some embodiments, the laundry additive apertures (117) fluidly connect to laundry additive reservoirs to hold detergent, bleach, fabric softener, and the like for use by the system (100) for washing the clothes.

In some embodiments, the system (100) comprises a door (120) pivotally located on the clothes aperture (116). In some embodiments, the door (120) seals the clothes aperture (116) when closed via a gasket and a sealing surface.

In some embodiments, the system (100) comprises a cylindrical perforated drum (130) rotatably suspended in an outer drum (140). In some embodiments, a perforation (135) is about ¼ inch in diameter. In some embodiments, a perforation (135) is about ½ inch in diameter. In some embodiments, a perforation (135) is about ¾ inch in diameter. In some embodiments, a perforation (135) is about one inch or more in diameter.

In some embodiments, the perforated drum (130) and the outer drum (140) are each located in the cavity (115). In some embodiments, the perforated drum (130) rotates within the outer drum (140) on a horizontal axis A (145). In some embodiments, an open semi-cylindrical scoop (136) is located on a drum exterior surface (131) of the perforated drum (130) on each perforation (135) for aiding airflow when drying and water flow when washing. In some embodiments, the end of the semi-cylindrical scoop (136) is rounded and smooth.

In some embodiments, the system (100) comprises a drying power system comprising a power source (150), a microprocessor (151) operatively connected to the power source (150), a user interface (152) located on the appliance housing front surface (111) operatively connected to the microprocessor (151), a drum motor (153) coupled to the drum (130) and operatively connected to the microprocessor (151), a blower (154) operatively connected to the microprocessor (151), and a heating element (155), operatively connected to the microprocessor (151). In some embodiments, the user interface (152) comprises one or more of the following: a touch screen, a knob, a button, or a switch.

In some embodiments, the power source (150) is 110 v or 220 v alternating current electricity. In some embodiments, the drum motor (153) is connected to a rear shaft of the perforated drum (130) via a belt or a chain and spins the drum.

Washing machines and dryers are well known to those of ordinary skill in the art having many standard components.

In some embodiments, the outer drum (140) is fluidly connected to an intake vent (160) close to an appliance housing bottom end (114) via ducting. In some embodiments, the outer drum (140) is fluidly connected to an exhaust vent (161) close to an appliance housing top end (113) via ducting, In some embodiments, the blower (154) is located in ducting close to the exhaust vent (161). In some embodiments, the blower (154) is located in ducting close to the intake vent (160). In some embodiments, the heating element (155) is located in the ducting close to the intake vent (160).

In some embodiments, the system (100) comprises a washing power system comprising the power source (150), the microprocessor (151) operatively connected to the power source (150), the user interface (152) located on the appliance housing front surface (111) operatively connected to the microprocessor (151), and a washer motor (156) coupled to the drum (130) and operatively connected to the microprocessor (151). In some embodiments, the was motor (156) is connected to a rear shaft of the perforated drum (130) via a belt or a chain and spins or oscillates the drum.

In some embodiments, the outer drum (140) is fluidly connected to hot and cold water supply piping (162). In some embodiments, the outer drum (140) is fluidly connected to a water drain (163).

In some embodiments, the system (100) comprises three modes of operation including a washing only mode, a drying only mode, and a sequential washing then drying mode.

In some embodiments, for washing garments are placed in the perforated drum (130) via the clothes aperture (116). In some embodiments, an operating program stored in the microprocessor (151) is activated via the user interface (152). In some embodiments, hot and/or cold water is introduced into the perforated drum (130). In some embodiments, the perforated drum (130) is oscillatingly rotated or spun via the washer motor (156). In some embodiments, a laundry additive is released into the drum (130) via the microprocessor (151) and one or more laundry additive valves. In some embodiments, water is drained from the drum (130) via the water drain (163).

In some embodiments, for drying, garments are placed into the drum (130) via the clothes aperture (116). In some embodiments, an operating program stored in the microprocessor (151) is activated via the use interface (152). In some embodiments, heated air is drawn into the perforated drum (130) via the heating element (155) and the blower (154) In some embodiments, the perforated drum (130) is spun via the drum motor (153).

In some embodiments, an intake vent (160) isolation valve (200) is located in the intake vent ducting and operatively connected to the microprocessor (151). In some embodiments, the intake vent isolation valve (200) is configured to be open during a drying cycle and closed during a washing cycle.

In some embodiments, an exhaust vent isolation valve (201) is located in the exhaust vent ducting and operatively connected to the microprocessor (151). In some embodiments, the exhaust vent isolation valve (201) is configured to be open during a drying cycle and closed during a washing cycle.

In some embodiments, a plurality of water supply valves (202) is located in the hot and cold water supply piping (162) and operatively connected to the microprocessor (151). In some embodiments the water supply valves (202) are configured to be closed during a drying cycle and both open and closed during a washing cycle.

In some embodiments, a drain valve (203) is located in the water drain (163) and operatively connected to the microprocessor (151). In some embodiments, the drain valve (203) is configured to be closed during a drying cycle and both open and closed during a washing cycle.

In some embodiments, the system (100) comprises a misting unit (210) located in the housing (110) parallel with the drum (130) for use during the drying cycle. In some embodiments, the misting unit (210) comprises a hollow tube having misting orifices (211) located in a series thereon. In some embodiments, the misting orifices (211) are aligned with a row of perforations (135) in the perforated drum (130). In some embodiments, the misting unit (210) is fluidly connected to the hot and cold water supply piping (162). In some embodiments, a misting valve (212) is fluidly located on the misting unit (210) and is operatively connected to the microprocessor (151). In some embodiments, in a drying cycle, the microprocessor (151) activates the misting valve (212) to allow water to flow therethrough to spray a water mist on the clothes in the drum (130) via the misting orifices (211). In some embodiments, in a drying cycle, the microprocessor (151) activates the misting valve (212) to allow water to flow therethrough to spray a water mist on the clothes in the drum (130) via the misting orifices (211) according to a program disposed in the microprocessor that sprays intermittently only through the perforations (135) of the perforated drum (130).

In some embodiments, a removable lint screen (220) is located in the exhaust vent (161).

In some embodiments one or more washing and drying programs or sequences are stored in the microprocessor (151) containing timer loops and predetermined operating sequences for opening and closing valves and operating motors.

As used herein, the term "about" refers to plus or minus 10% of the referenced number.

The disclosures of the following U.S. Patents are incorporated in their entirety by reference herein: U.S. Patent Pub.

No. 2001/0015082 A1; U.S. Pat. No. 6,748,772; U.S. Pat. No. 6,530,245; U.S. Pat. No. 6,434,857; U.S. Pat. No. 5,020,458; and U.S. Pat. No. 2,777,313.

Various modifications of the invention, in addition to those described herein, will be apparent to those skilled in the art from the foregoing description. Such modifications are also intended to fall within the scope of the appended claims. Each reference cited in the present application is incorporated herein by reverence in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way, In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A space saving clothes washing and drying system (100), wherein the system (100) comprises:

(a) an appliance housing (110) having a cavity (115) disposed therein, wherein the appliance housing (110) comprises a clothes aperture (116) disposed on an appliance housing front surface (111) thereon, wherein the appliance housing (110) comprises a plurality of laundry additive apertures (117) disposed on an appliance housing top surface (112) thereon;

(b) a door (120) pivotally disposed on the clothes aperture (116), wherein the door (120) seals the clothes aperture (116) when closed;

(c) a cylindrical perforated drum (130) rotatably suspended in an outer drum (140), wherein the perforated drum (130) and the outer drum (140) are each disposed in the cavity (115), wherein the perforated drum (130) rotates within the outer drum (140) on a horizontal axis A (145), wherein an open semi-cylindrical scoop (136) is disposed on a drum exterior surface (131) of the perforated drum (130) on each perforation (135) for aiding airflow;

(d) a drying power system comprising a power source (150), a microprocessor (151) operatively connected to the power source (150), a user interface (152) disposed on the appliance housing front surface (111) operatively connected to the microprocessor (151), a drum motor (153) coupled to the drum (130) and operatively connected to the microprocessor (151), a blower (154) operatively connected to the microprocessor (151), and a heating element (155), operatively connected to the microprocessor (151), wherein the outer drum (140) is fluidly connected to an intake vent (160) proximal to an appliance housing bottom end (114) via ducting, wherein the outer drum (140) is fluidly connected to an exhaust vent (161) proximal to an appliance housing to end (113) via ducting, wherein the blower (154) is disposed in the ducting proximal to the exhaust vent. (161), wherein the heating element (155) is disposed in the ducting proximal to the intake vent (160); and (e) a washing power system comprising the power source (150), the microprocessor (151) operatively connected to the power source (150), the user interface (152) disposed on the appliance housing front surface (111) operatively connected to the microprocessor (151), a washer motor (156) coupled to the drum (130) and operatively connected to the microprocessor (151), wherein the outer drum (140) is fluidly connected to hot and cold water supply piping (162), wherein the outer drum (140) is fluidly connected to a water drain (163);

wherein the system (100) comprises three modes of operation including a washing only mode, a drying only mode, and a sequential washing then drying mode;

wherein for washing, garments are placed in the perforated drum (130), wherein an operating program stored in the microprocessor (151) is activated via the user interface (152), wherein hot and/or cold water is introduced into the perforated drum (130), wherein the perforated drum (130) is oscillatingly rotated or spun via the washer motor (156), wherein a laundry additive is released into the drum (130) via the microprocessor (151) and one or more laundry additive valves, wherein water is drained from the drum (130) via the water drain (163);

wherein for drying, garments are placed into the perforated drum (130), wherein an operating program stored in the microprocessor (151) is activated via the user interface (152), wherein heated air is drawn into the drum (130), via the heating element (155) and the blower (154) wherein the drum (130) is spun via the drum motor (153).

2. The system (100) of claim 1, wherein an intake vent (160) isolation valve (200) is disposed in the intake vent ducting and operatively connected to the microprocessor (151), wherein the intake vent isolation valve (200) is configured to be open during a drying cycle and closed during a washing cycle.

3. The system (100) of claim 1, wherein an exhaust vent isolation valve (201) is disposed in the exhaust vent ducting and operatively connected to the microprocessor (151), wherein the exhaust vent isolation valve (201) is configured to be open during a drying cycle and closed during a washing cycle.

4. The system (100) of claim 1, wherein a plurality of water supply valves (202) is disposed in the hot and cold water supply piping (162) and operatively connected to the microprocessor (151), wherein the water supply valves (202) are configured to be closed during a drying cycle and both open and closed during a washing cycle.

5. The system (100) of claim 1, wherein a drain valve (203) is disposed in the water drain (163) and operatively connected to the microprocessor (151), wherein the drain valve (203) is configured to be closed during a drying cycle and both open and closed during a washing cycle.

6. The system (100) of claim 1, wherein the system (100) comprises a misting unit (210) disposed in the housing (110) parallel with the drum (130) for use during the drying cycle, wherein the misting unit (210) comprises a hollow tube having misting orifices (211) disposed in a series thereon, wherein the misting orifices (211) are aligned with a row of the perforations (135) in the perforated drum (130), wherein the misting unit (210) is fluidly connected to the hot and cold water supply piping (162), wherein a misting valve (212) is fluidly disposed on the misting unit (210) and is operatively connected to the microprocessor (151), wherein in a drying cycle, the microprocessor (151) activates the misting valve (212) to allow water to flow therethrough to spray a water mist on the clothes in the drum (130) via the misting orifices (211).

7. The system (100) of claim 1, wherein a removable lint screen (220) is disposed in the exhaust vent (161).

* * * * *